US006199347B1

(12) United States Patent
Muller et al.

(10) Patent No.: US 6,199,347 B1
(45) Date of Patent: Mar. 13, 2001

(54) DEVICE FOR SEALING LIDS ONTO PACKAGES

(75) Inventors: Michael Muller, Karlsruhe; Rolf Zierdt, Seeheim-Jugenheim, both of (DE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 09/331,525

(22) PCT Filed: Nov. 25, 1997

(86) PCT No.: PCT/EP97/06570

§ 371 Date: Sep. 16, 1999

§ 102(e) Date: Sep. 16, 1999

(87) PCT Pub. No.: WO98/28191

PCT Pub. Date: Jul. 2, 1998

(30) Foreign Application Priority Data

Dec. 24, 1996 (DE) ..... 196 54 373

(51) Int. Cl.[7] ..... B65D 45/00

(52) U.S. Cl. ..... 53/319; 53/167; 53/264; 53/329

(58) Field of Search ..... 53/167, 319, 264, 53/329, 329.5, 135.1, 478, 556; 413/63, 64, 58, 9, 10

(56) References Cited

U.S. PATENT DOCUMENTS 4,035,987 * 7/1977 Nakazato et al. ..... 53/329
4,155,786 * 5/1979 Corbic ..... 53/556
4,362,002 * 12/1982 Rowland et al. ..... 53/478
4,446,673 * 5/1984 Desthieux ..... 53/264
5,371,996 * 12/1994 Ueda et al. ..... 53/329.5
5,406,772 * 4/1995 Dinius ..... 53/264

* cited by examiner

*Primary Examiner*—Peter Vo
*Assistant Examiner*—Sam Tawfik
(74) *Attorney, Agent, or Firm*—Michael L. Dunn

(57) ABSTRACT

An apparatus for sealing tops onto openings of packs arranged at a distance (m) from each other. The apparatus includes a first conveying means, e.g. a first conveyor, for intermittently conveying the packs in a first direction of travel through a row of at least three sealing stations spaced a machine pitch (m) from each other, and a transport apparatus, e.g. a second conveyor, for transporting the tops in a row behind each other and transversely to the first direction of travel, intermittently over the openings of packs located in the row of sealing stations. The transport apparatus includes a tops belt guided over drive rollers to which the tops are detachably attached behind each other using holding bridges. The tops are spaced a belt pitch (t) from each other and the tops belt is provided with positioning apparatus for properly positioning the tops over the openings. Fixed measurement and display apparatuses are attached in front of and behind the row of sealing stations to provide data permitting a predetermined length of belt over the openings of the packs in the row of sealing stations so that the center of each top, on the belt over the openings, lies over the center of a pack opening.

23 Claims, 7 Drawing Sheets

DEVICE FOR SEALING LIDS ONTO PACKAGES

BACKGROUND OF THE INVENTION

1. Field of the Invention

The invention relates to a device for sealing tops, in particular tops made from films coated with sealable material, onto the openings of packs arranged at a distance from each other and intermittently conveyed by first conveying means in a first direction of travel.

2. Description of Related Art

It is known to close cup-shaped packs with round aluminum tops after filling the packs by sealing the tops onto the upper rim of the cups. The round tops are stacked in storage columns, removed by suction devices and placed on tongs which are arranged in pairs opposite each other and convey the tops by relative movement of the tongs relative to each other in a transport direction which is perpendicular to the direction of travel of the packs. In particular when packaging foodstuffs and using a germ-free space, complicated tong-conveyance apparatuses in a long tunnel for sterilization are necessary, so that the entire device becomes complicated and accident-prone. In order to provide the known device with a somewhat acceptable capacity, numerous transport lines are provided for the tops, each of which has the complicated mechanism mentioned, so that the danger of mistakes occurring is considerable although capacity is only moderate.

BRIEF SUMMARY OF THE INVENTION

The object of the invention is to create a similar device with a greater capacity and to design it so that the device allows the tops to be delivered to the packs more easily in spite of the increased capacity.

This objective is achieved according to the invention in that:

a) transport means are provided in order to transport the tops in a row behind each other and transversely to the direction of travel of the packs intermittently over the openings of at least 3 packs situated in a row of sealing stations and spaced a machine pitch from each other;

b) the transport means have a belt, guided over drive rollers, to which the tops are detachably attached behind each other via holding bridges spaced a pitch belt from each other and which has positioning apparatuses; and c) fixed measurement and display apparatuses are attached in front of and behind the row of sealing stations.

More particularly the invention comprises an apparatus for sealing tops onto openings of packs arranged at a distance (m) from each other. The apparatus comprises a first conveying means, e.g. a first conveyor, for intermittently conveying the packs in a first direction of travel through a row of at least three sealing stations spaced a machine pitch (m) from each other, and a transport means, e.g. a second conveyor, for transporting the tops in a row behind each other and transversely to the first direction of travel, intermittently over the openings of packs located in the row of sealing stations. The transport means comprises a tops belt guided over drive rollers to which the tops are detachably attached behind each other by means of holding bridges. The tops are spaced a belt pitch (t) from each other and the tops belt is provided with positioning apparatus for properly positioning the tops over the openings. Fixed measurement and display apparatuses are attached in front of and behind the row of sealing stations to provide data permitting a predetermined length of belt over the openings of the packs in the row of sealing stations so that the center of each top, on the belt over the openings, lies over the center of a pack opening.

DETAILED DESCRIPTION OF THE INVENTION

Figure 1:
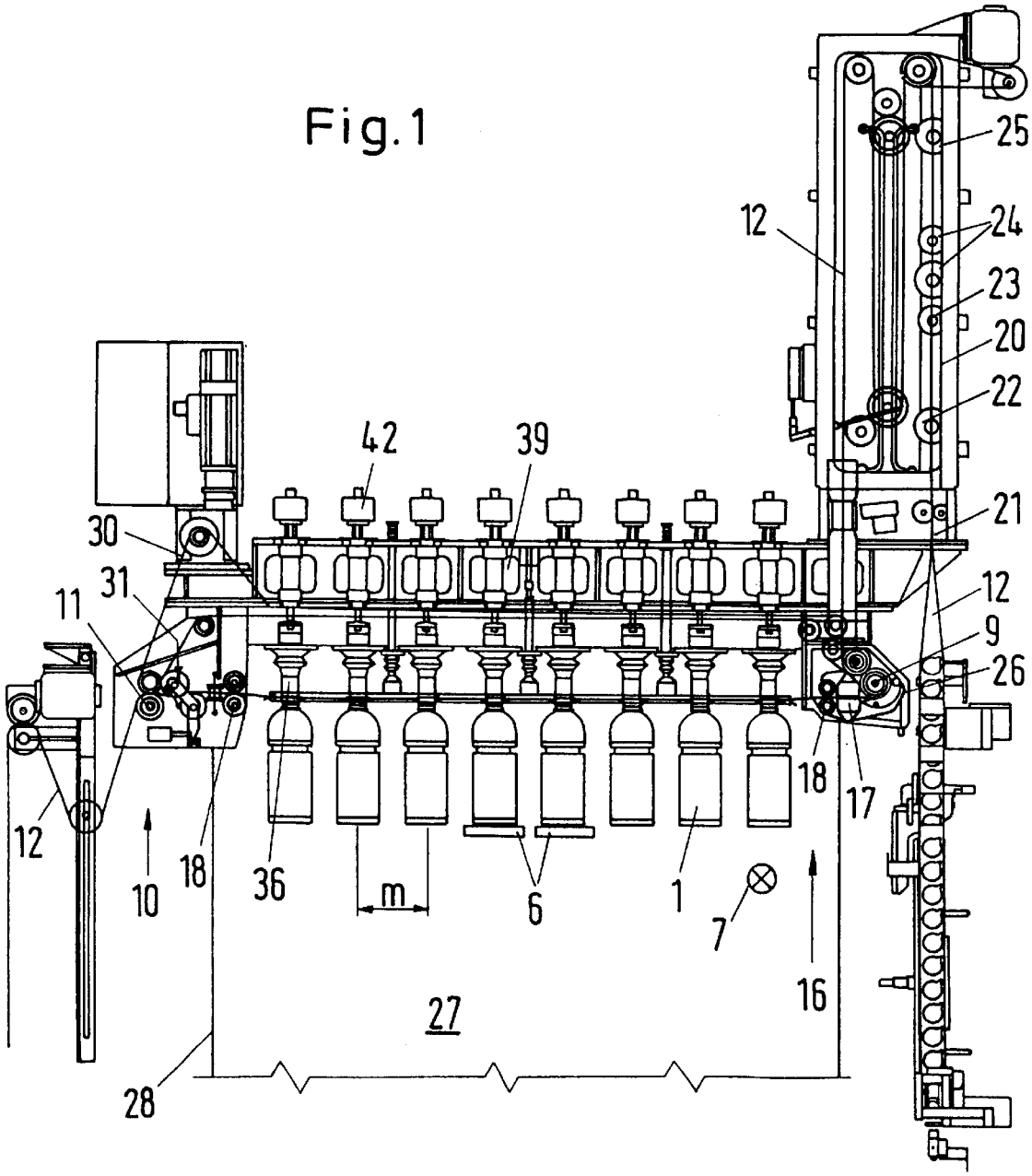
FIG. 1 shows the front view of a sealing device looking in the direction of travel of the packs.

In contrast to the previous devices, the tops are fed according to the invention in the form of a tops belt in which the tops are partially punched out and for the rest detachably attached via holding bridges at a distance from each other. Via the positioning apparatuses mentioned, it is possible in connection with the measurement and display apparatuses to arrange a certain length of the belt exactly over the openings of the at least three packs so that the centre of each top comes to lie over the centre of the pack opening. The measurement and display apparatuses allow the exact adjustment and stopping of the tops belt at the correct moment.

The advantage of the tops belt is that the tops can be fed, moved and stopped as in one piece. This not only makes them easier to handle, but they can also be exactly positioned in conjunction with the measuring and display apparatus.

The capacity of the new device is further increased vis-à-vis the conventional devices because at least 3 packs are dealt with and closed simultaneously with the tops by the measures according to the invention. The operation is easier even when changing a cartridge because if either a stock roller has run out during operation with a tops belt and must be replaced by a new stock roller, or if another shape or size of top is desired then only the roller with the tops belt needs to be removed and replaced by a new one. This process requires considerably less time than the replacement of columns of tops stacked on top of one another.

The capacity of the device according to the invention can easily be further increased by not only arranging the tops belt over 3 packs at the same time but over a longer row of several packs arranged behind each other and then sealing on. For this purpose, this has proved expedient if 4, 6 or 8 packs are put together to form a row and provided with a top at the same time.

This is carried out each time in a sealing station, a number of which sealing stations corresponding to the number of packs is to be arranged. The sealing stations are also arranged in a row according to the packs. If you imagine that you are looking at a row of eight packs spaced one machine pitch apart from each other, then the row of eight sealing stations above them is easily imaginable. "Above them" means here that for the most part filled packs have their filling and pouring opening at the top so that the top is attached from above because then flowable contents in particular can be packed. Therefore the sealing station must engage with the top end of the pack and be arranged above them.

It is conceivable, under the previous condition that the packs are intermittently conveyed in a first direction of travel, that this direction of travel lies perpendicular to the row of the packs standing under the sealing stations. In this way a row of eight packs can be intermittently brought in succession under the row of sealing stations cycle by cycle in the mentioned first direction of travel transversely to the longitudinal extension of the pack row and also moved from these again. The distance of the eight packs from each other in the individual row considered is the machine pitch mentioned.

The transport direction of the tops belt running in the direction of the row of packs and transversely to their direction of travel is rectilinear and congruent with the longitudinal direction of the row of the sealing stations.

According to the invention every sealing station has a belt bridge arranged over the packs and movably driven relative to these and a sealing head movably driven relative to the belt bridge. The movement of the bridge and of the head are to be thought of as from top to bottom and vice versa, therefore in vertical direction. With the help of the belt bridge, the tops belt can be moved exactly into the correct positions over the packs and than even relative to the openings of the packs lowered onto these. The drive of the sealing head, which is connected independently of the drive of the belt bridge, takes care of its operation in particular sealability of the top onto the pack; after that, raising and removing the parts from the pack so that all the packs in the row can be taken out of the row of sealing stations.

To increase the precision of operation, the sealing-on device according to the invention is further characterized in that a stretching device is arranged at the exit-side end of the tops belt from the row from the sealing stations and between drive rollers for the belt. The tops belt is brought into the desired position by an entrance-side drive roller relative to the row of sealing stations incoming side end and an exit-side drive roller arranged opposite at a distance from it. From here, the positioning of the tops belt would already be sufficiently precise, when it is considered that the very effective transport means with mandrel wheels, belts with transport holes etc. are used. But if tops made from films are used, tolerances of the considered tops belt are often already recorded because of the manufacture of such a film. A tolerance of ±1½ mm for a length of a tops belt made from a film of roughly lm is nothing special. It would therefore be possible without particular measures under certain circumstances that, despite precise drives of the tops belt, the tops do not lie exactly on all pack openings at the same time. Problems arise in particular with the tops belts which are too long and then sag. In connection with the feed of the tops by means of a tops belt, as is proposed here according to the invention, there are problems in particular with long rows of packs of more than 3, 6 or 10 packs caused by the manufacturing tolerances of the tops belts.

These very problems, however, are surprisingly and satisfactorily solved if the mentioned stretching device is arranged at the exit-side end of the row of sealing stations. With its help, a tops belt which is optionally known in advance to be too short is stretched to the desired length. This stretching is achieved for example by giving a vertical component to the essentially horizontal-running tops belt on a certain stretch, resulting in a tensioning, an elongation and thus also stretching of the tops belt. It is understood that the stretch is precisely adjustable. The stretching device can remain in this adjusted state beyond a lengthy operating period, so that after every stop during the intermittent feed movement of the tops belt, the latter always has the right length, with the result that the centres of the tops also come to lie on the centre of the pack openings.

It is possible, with a suitable size of the pack opening and of the top compared with the diameter of the associated pack, that the belt pitch is not always the same as the machine pitch. In order to save material of the tops belt it is therefore furthermore provided according to the invention that the machine pitch is three times the belt pitch when the belt is stretched. With the help of the stretching device the most precise results are easily achieved when the belt is stretched so that during pitch comparisons the wall pitch when the belt is stretched is considered. In a practical embodiment, a belt pitch of 50.65 mm in cold state resulted, which was increased by machine-related treatments and by stretching to a set value of 50.8 mm. Calculation was based on this belt pitch in the stretched belt. Then it was shown as expedient if, when advancing the tops belt by one cycle with a row of eight packs or sealing stations, this tops belt advances by eight times the belt pitch, in the case of the actual example mentioned, advances by 406.4 mm. It was further borne in mind that the machine pitch is equal to three times the belt pitch when the belt is stretched, not when the belt is relaxed and/or cold (a film belt is also known to expand with heat). When the belt was stretched, the machine pitch was then 152.4 mm.

Through the mentioned belt bridge, in operation the tops belt is firstly pulled through slack and without much friction, the stretching device remaining in its once adjusted position and the drive rollers advancing the belt by the mentioned length.

This happens particularly favorably in that according to the invention the belt bridge is an oblong hollow body with a box-type profile in cross-section to take up slackly and guide the tops belt further, that centering rings are distributed over the row of sealing stations and attached to the belt bridge a machine pitch apart from each other and that the front end of the sealing station is preferably movable through the centering ring. The front end is found underneath at the sealing head, as this moves forward onto the opening of the pack arranged at the top. The centering ring equalizes further possible tolerances. If the packs do not stand exactly at the calculated centre positions or a machine pitch apart, then the centering rings deal with simple corrections, so that a precise positioning is achieved here after the belt bridge with the centering rings is pressed onto the upper side, in particular onto the opening, of the pack concerned. Independently of the movement of the belt bridge, the sealing head is then pressed down forwards in engagement with the pack opening and carries out the sealing of the top onto the pack opening. Still during the engagement of the sealing head with the pack opening the belt bridge is pulled back upwards relative to the sealing head from the pack opening. The tops belt is located however in the belt bridge and is entrained with the box-type profile while the tops which are punched out are (apart from the holding bridges) held on the pack opening by the sealing head. In other words, because of this movement of the belt bridge up and away from the pack opening, the lid is separated or loosened from its belt because the holding bridges tear at this moment.

Shortly afterwards the sealing process ends and the sealing head is loosened from the pack opening and pulled upwards and away. All machine parts of the sealing station are thereby loosened from the pack and also its opening apparatus arranged at the top and at a distance, so that the packs can be moved out and away from this in the above mentioned first direction of travel under the sealing station.

To increase the safety, it is furthermore provided according to the invention that a measurement and display apparatus is arranged between the exit-side end of the row of sealing stations and the stretching device. This apparatus is also preferably similarly constructed to the first-described apparatuses and for example comes into active engagement with positioning means in the tops belt. Concretely, the measurement and display apparatus can have photo cells which can then be lit by positioning holes in the tops belt when the position hole stands exactly over the photo cells in a set position. But if a control sensor for example indicates an incorrect position, say because the position hole does not stand over a photo cell at the correct point, then switching-off processes are triggered. For example the sealing operation is switched off. The same also happens if the tops belt is incorrectly guided or even torn. These mistakes can also be recorded by the device according to the invention and further damage avoided. Therefore a high degree of safety of the high-capacity device is guaranteed in spite of its simple design.

The device according to the invention can be used for packing foodstuffs and in particular for sterile treatment, for example for closing. To this end it is provided according to the invention that a hygiene chamber is provided by means of a hood, preferably open on one-side and enclosing the row of sealing stations, and that a sterilizing chamber is provided enclosing the feed path of the tops belt. While the tops belt on the stock roller or in the magazine can still be kept unsterile, it is taken off from there and fed into the sterilization chamber where a suitably long sterilization path of the tops belt is provided by guide rollers. The routes are encapsulated from the sterilization chamber, via the drive rollers, the measurement and display apparatuses to the hygiene chamber so that the sterile state of the tops belt is not lost. In the area of the sealing stations, the tops belt is of course still in the hygiene chamber so that foodstuffs can also be packaged easily and hygienically by the device according to the invention, kept filled and closed. The hygiene chamber is preferably continuously charged with sterile air, so that even when the closed, filled packs are removed from the hygiene chamber, no germs can enter this chamber even from the outside.

Further advantages, features and possible applications of the present invention emerge from the following description of preferred embodiments in connection with the accompanying drawings. It is shown in:

Tops 2 in the form of rounds are to be sealed onto packs 1 in the form of bottles. Each pack 1 has an opening 3 above onto each of which a top 2 is to be sealed. In the top view of FIG. 3, the rows 4 of packs 1 arranged at a distance from each other (machine pitch m) can be seen as horizontal rows. Each pack is to be thought of as arranged under a sealing station 5 so that the row 5' of sealing stations 5 can also be seen from FIG. 3.

Figure 3:
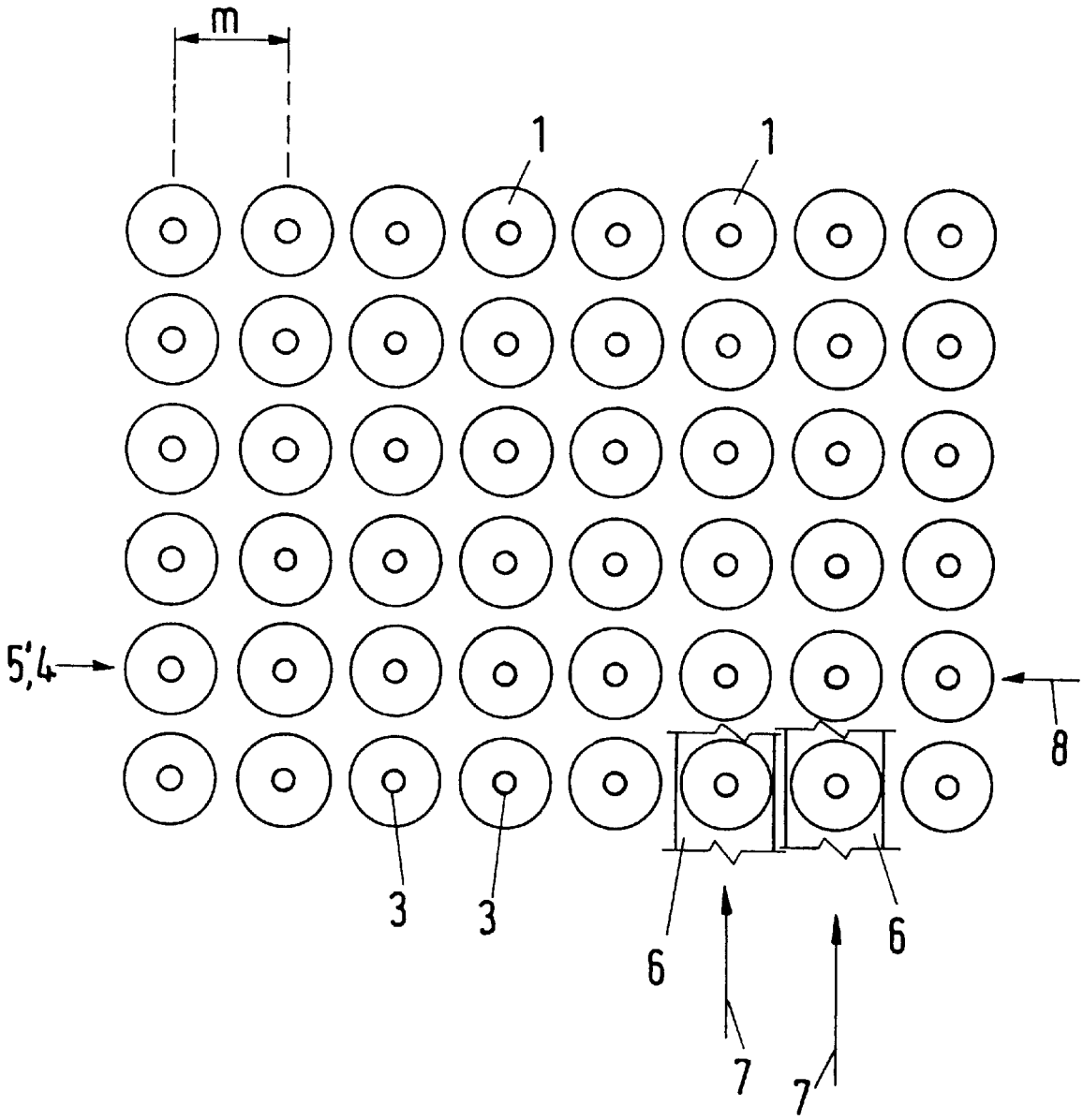
FIG. 3 shows a plan view of various rows of packs, looking in FIG. 1 from top to bottom, namely perpendicular both to the direction of travel of the packs and to the transport direction of the tops belt.

As first conveyance means for the packs 1, conveyor belts 6 are shown at only two points in the FIGS. 1 and 3. It is however understood that these conveyor belts 6 are arranged along each processing line b. In addition, a bridge arranged under or over the packs is also conceivable so that the whole row 4 of packs 1 can be intermittently conveyed at once in the first direction of travel 7. In FIG. 1, it can be seen how the first direction of travel 7 of the packs 1 stands perpendicular on the plane of the paper and is set up in the direction of vision of the viewer.

The transport direction 8 of the tops 2 runs transversely to this first direction of travel 7 of the packs 1 in the row 5' of the sealing stations 5. This horizontal transport direction 8, directed roughly transversely to the first direction of travel, of the tops 2 is found between the entrance-side drive roller 9 and at the opposite, exit-side end 10 of the tops 2 of the exit-side drive roller 11.

Figure 4:
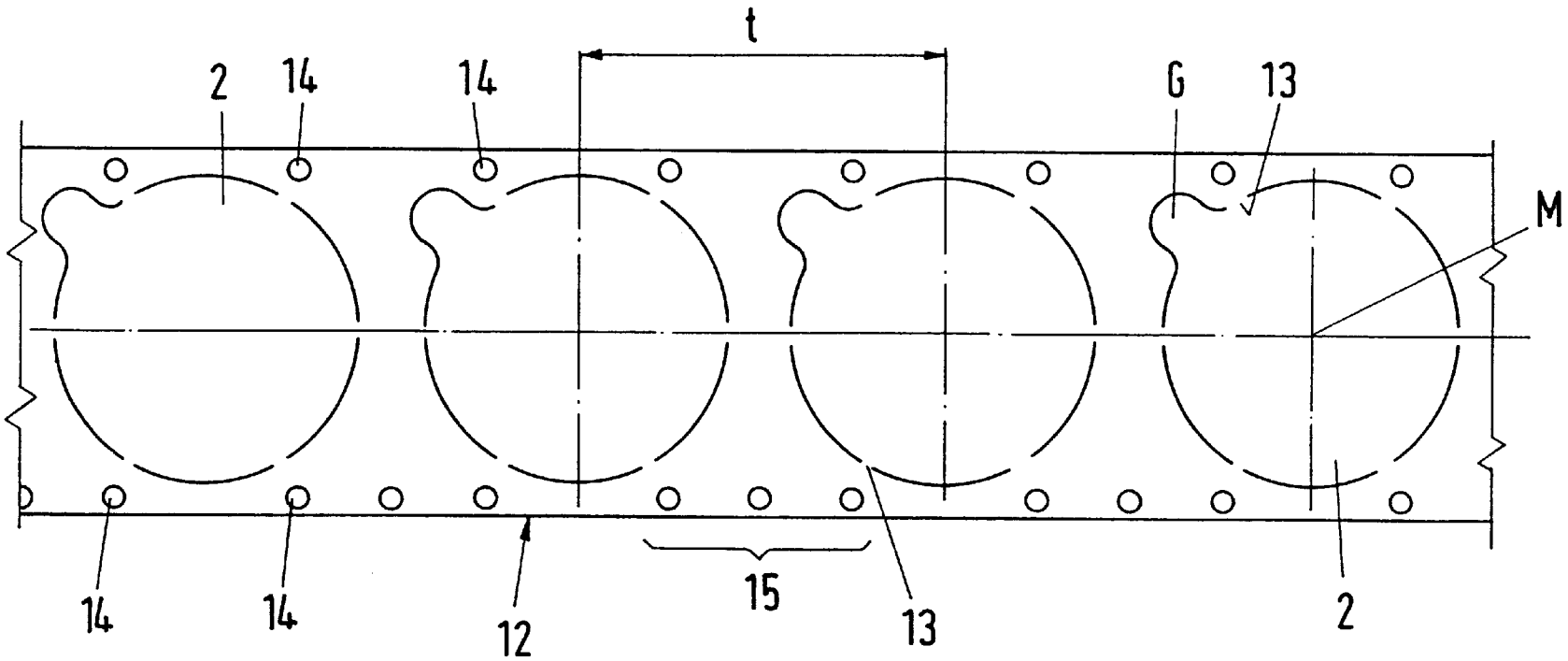
FIG. 4 shows a broken view showing the top of a part of the tops belt with four tops in the form of rounds.

The tops 2 are fed in the form of a tops belt 12. This consists of a plastic film laminated with aluminium as is shown section-wise in FIG. 4. The tops have the shape of rounds with a centre point M and tabs E. The circular lines in FIG. 4 are punching lines along which the tops 2 of the tops belt 12 are punched. Only holding bridges 13 still hold the tops 2 in the belt 12. The centre point M of two tops 2 arranged behind each other a belt pitch t apart lie in its longitudinal direction. In addition, transport holes 14 can be recognized in the edges of the tops belt 12 as well as groups of three position holes 15 in order to be able to ascertain the position of the tops belt 12 with high precision with the aid of three photocells arranged behind each other.

Figure 6:
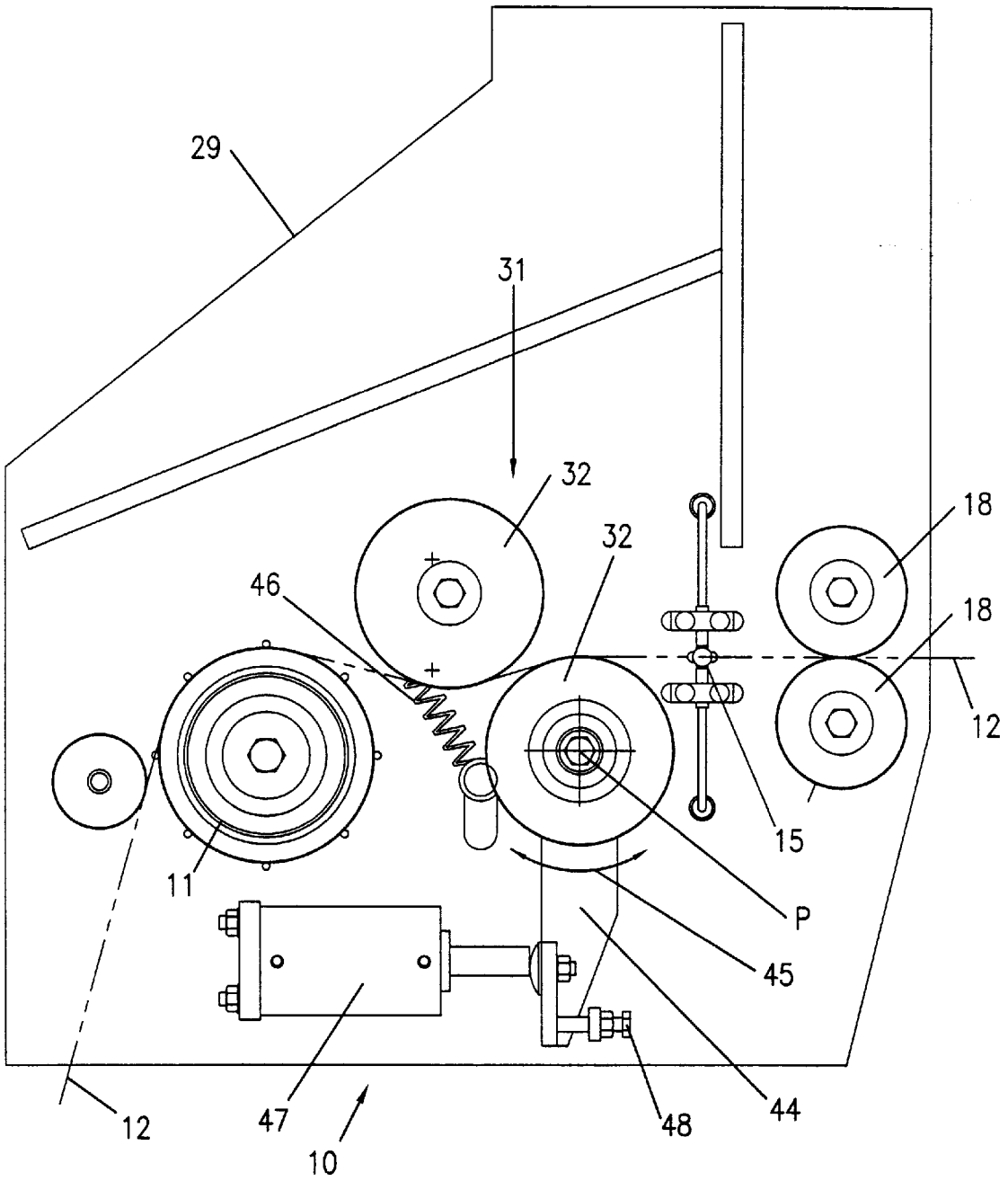
FIG. 6 shows an enlarged view of the housing shown from the left in FIG. 1 with the stretching device.

One such photocell 15' is arranged at the exit-side end 10 of row 5' of sealing stations 5 as can be seen in FIGS. 1 and 6. Triple photocells 17 are located at the entrance-side end 16 in a housing. Two guide rollers 18 are located beside photocells 15' and 17, each toward the center of the machine.

Figure 2:
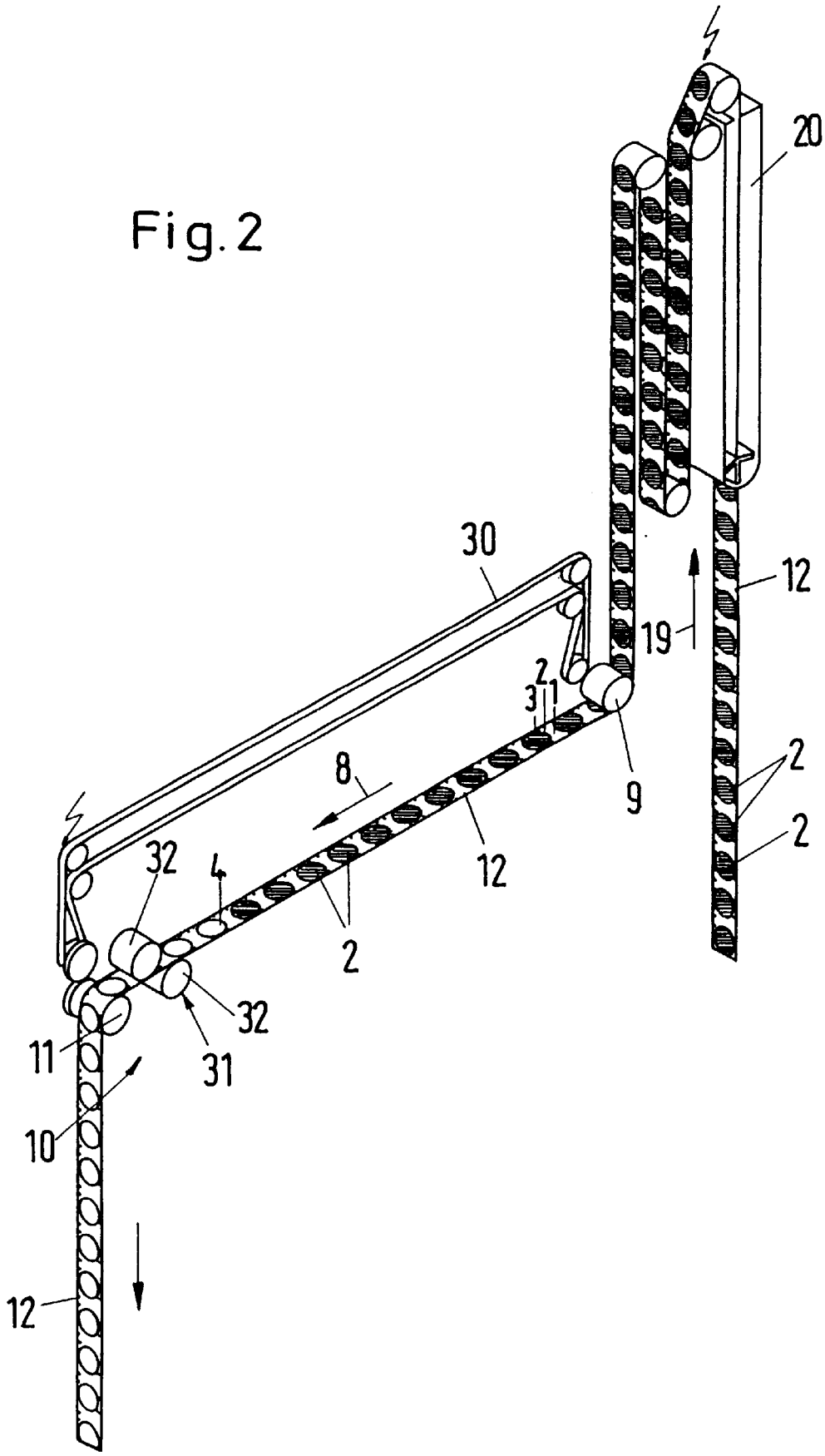
FIG. 2 shows a perspective, schematic view of the route of the tops belt.

From FIGS. 1 and 2, the route of the tops belt 12 can be seen, running first from bottom to top in the direction of the arrow 19 with the punched-out tops 2 in a sterilization chamber 20 which the belt 12 in FIG. 1 enters at the bottom on the right through a sealed-off narrow gap 21. By supplying sterile hot air through the nozzle 22, an above-atmospheric pressure is reached in the sterilization chamber 20 and the belt 12 pre-heated. Hydrogen peroxide emerges from the nozzle 23 in gas form. Further up in the direction of transport 19, nozzles 24 follow for the insufflation of sterile hot air and any liquid is dried off by means of the drying nozzles 25 arranged above them. After various turns, the belt 12 leaves the sterilization chamber downwards to the entrance-side housing 26 which is also a clean area. The entrance-side drive roller 9 effects the decisive routing and the start in the discussed, essentially horizontal transport direction 8 into the row 5' of sealing stations 5. The sealing stations 5 are situated in the hygiene chamber 27 which is formed by a hood 28 open at the bottom. After emerging from the exit-side housing 29 (FIGS. 1 and 6), the belt 12 leaves the machine without the tops 2 which were previously torn off along the row 5' of the sealing stations 5, as will be described. In FIG. 2, it is seen that, from the point described with a position "4", the belt 12 has holes instead of tops 2. These holes are shown in white in FIG. 2 compared with the tops 3 which are more striking as black spots.

An open-drive belt 30 (FIG. 2) ensures the synchronous drive of the drive rollers 9 and 11 so that the tops belt 12 does not tear.

In FIGS. 1 and 2, the stretching device 31 in the form of two tension rollers 32 is also indicated at the exit-side end 10 of the tops belt 12.

Through the apparatus as described above, it is possible, via the eight packs 1 selected in the example shown here of the pack row 4 in the row 5' of the sealing stations 5, to arrange the tops 2 with their centres M over the openings 3 of the packs 1. The intermittent advance of the tops belt 12 is eight times the belt pitches in one cycle.

Figure 5:
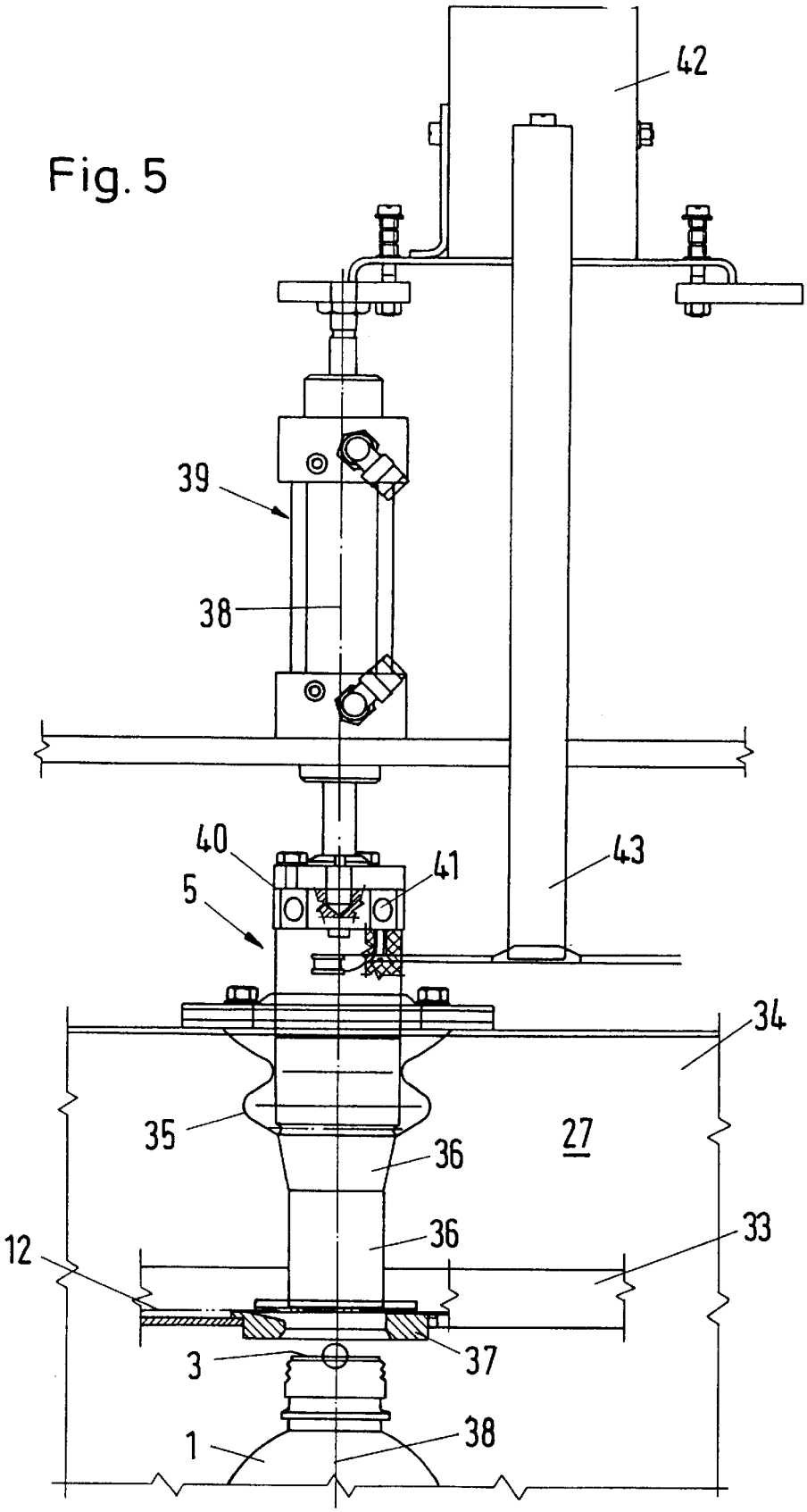
FIG. 5 shows an enlarged front view of the upper side of a pack with a sealing station arranged above it.

For sealing, a sealing station 5 with a belt bridge 33 driven separated movable relative to the packs 1 is situated over each pack 1 of the row 4. A sealing head 36 driven separately movable relative to the belt bridge and to the pack 1, and sealed off via rubber bellows 35, is also movably held by the frame numbered 34 in FIG. 5. The movements of the belt bridge 33 and also of the sealing head 36 are to be thought of as vertical upwards and downwards, thus when regarding FIG. 3 looking perpendicularly onto the paper in the direction of vision and the opposite. Centering rings 37 are affixed underneath at the belt bridge 33, with whose help, when the belt bridge 33 with the centering rings 37 is pressed onto the upper part of the pack 1 with the opening 3, the opening is centered onto the vertical centre line 38. The compressed-air cylinder 39 ensures the upward and downward movement of the sealing head 36, and 40 indicates a device for the central alignment of an inductor, as in the case selected here with the aluminium tops, the sealing head is an induction sealing head. This alignment device 40 is cooled via the water cooler 41. The energy is fed in by the transformer 42 via the HF current feed 43. The front end of the sealing head 36 fits, as can be seen from FIG. 5, through the opening of the centering ring 37.

Figure 7E:
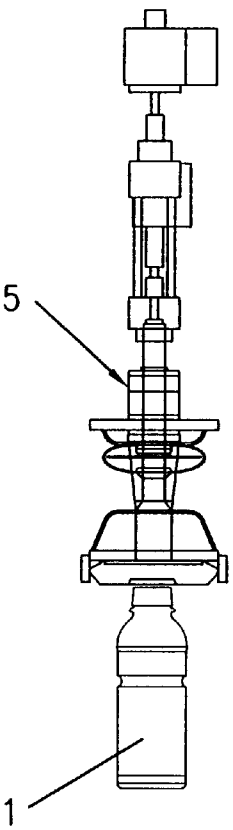
FIGS. 7*a* through 7*e* show one of the sealing stations shown in FIGS. 1 and 5 with packs arranged underneath them in various movement phases.
Figure 7D:
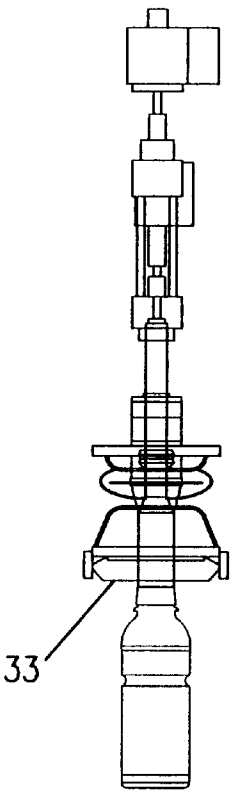
Figure 7C:
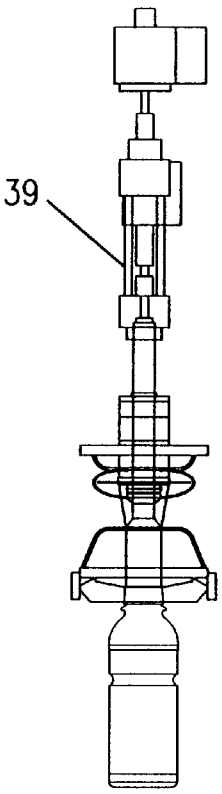
Figure 7B:
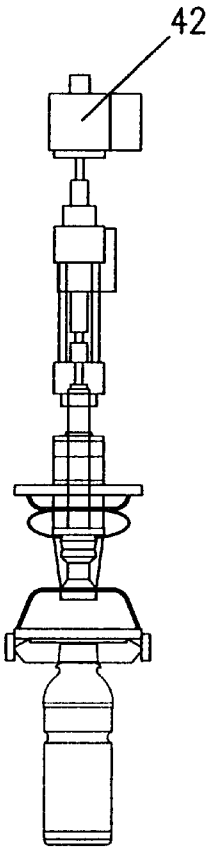
Figure 7A:
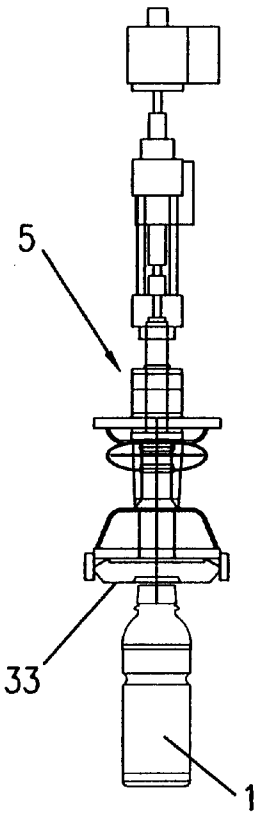

Sealing is carried out as represented in FIGS. 7*a* through 7*e*, by first moving the pack 1 under the sealing station 5 in the position shown in FIG. 7*a*. Simultaneously, the tops 2 have been drawn into the belt bridge 33 in transverse direction so that a top lies over the opening 3 of each pack 1. When, the position shown in FIG. 7*b*, the belt bridge 33 is lowered, the pack necks or the openings 3 are centered and the top 2 with the belt 12 comes to rest on the opening 3.

In the position shown in FIG. 7*c*, the sealing head 36 is fitted and the sealing begins. The required sealing pressure is generated by the pneumatic cylinder 39. Still during the sealing, the belt bridge 33, the belt bridge 33 moves vertically in an upwards direction, and the tops 2 are torn out of the tops belt 12. The position shown in FIG. 7*d* is then reached.

In the meantime, the top 2 in question is sealed onto the opening 3 of the pack 1. The sealing head 36 is also therefore raised into the position shown in FIG. 7*e* so that both the tops belt 12 and the packs 1 can be moved forward in cycles in direction 7 and 8.

In particular in the case of sterilization and pre-heating by means of nozzle 22, the tops belt 12 experiences an expansion which is neutralized by the stretching device 31 located in the exit-side housing 29. Two tension rollers 32 are coupled together via a clamping lever 44 around the point P, i.e. the fulcrum of the lower tension roller 32, so that the upper tension roller 32 can be rotated along the curved arrow 45 around the point P.

Although the tops belt 12 has already been given a curvature visible in FIG. 6 and thus the belt 12 a pre-tension by the tension spring 46, the exact denting of the belt 12 over the upper tension rollers 32 is ultimately carried out via the compressed-air cylinder 47 for the final tension in the belt 12. The adjustment can be fixed via the stop screw 48, to delimit the tension such that the top 2 in question stands in the form of the round with a centre point M centrally above the opening 3 of the pack 1.

LIST OF REFERENCE NUMBERS

1 Pack
2 Top
3 Pack opening
4 Pack row
5 Sealing station
5' Row of sealing stations
6 Conveyor belts
7 First direction of travel
8 Transport direction
9 Drive roller
10 Exit-side end of the drive roller
11 Drive roller on the exit-side
12 Tops belt
13 Holding bridges
14 Transport holes
15 Position holes/photocells
16 Entrance-side housing end
17 Housing
18 Guide rollers
19 Arrow—transport direction
20 Sterilization chamber
21 Gap
22 Hot air nozzle
23 Nozzle for hydrogen peroxide
24 Nozzle (insufflation of sterile hot air)
25 Drying nozzle
26 Entrance-side housing
27 Hygiene chamber
28 Open hood
29 Exit-side housing
30 Open-drive belt
31 Stretching device
32 Tension rollers
33 Belt bridge
34 Frame
35 Rubber bellows
36 Sealing head
37 Centering rings
38 Vertical centre line
39 Compressed-air cylinder
40 Alignment device
41 Water cooler
42 Transformer
43 HF current supply
44 Sealing head—front end/clamping lever
45 Arrow (direction of rotation)
46 Tension spring
47 Compressed-air cylinder
48 Stop screw
M Centre point of the tops
P Fulcrum of tension roller
b Processing line of conveyor belts

What is claimed is:

1. An apparatus for sealing tops (2) onto openings (3) of packs (1) arranged at a distance (m) from each other, said apparatus comprising:

(a) a first conveying means (6) for intermittently conveying the packs in a first direction of travel (7) through a row (5') of at least three sealing stations (5) spaced a machine pitch (m) from each other;

(b) transport means (9, 11, 12, 18, 30) for transporting the tops (2) in a row (4) behind each other and transversely to the first direction of travel (7) of the packs (1) intermittently over the openings (3) of packs (1) situated in the row (5') of sealing stations (5), said transport means (9, 11, 12, 18, 30) comprising a tops belt (12) guided over drive rollers (9, 11) to which the tops (2) are detachably attached behind each other by means of holding bridges (13) spaced a belt pitch (t) from each other, said tops belt being provided with positioning apparatuses for properly positioning the tops over the openings; and (c) sensing means (15', 17) attached in front of and behind the row (5') of sealing stations (5) for providing data permitting a predetermined length of belt over the openings of the packs in the row of sealing stations so that the center of each top, on the belt cover the openings, lies over the center of a pack opening.

2. Apparatus according to claim 1, wherein each sealing station (5) has a belt bridge (33) arranged over the packs (1) that is movably driven relative to packs (1), and a sealing head (36) movably driven relative to packs (1).

3. Apparatus according to claim 2 wherein a hygiene chamber (27) is provided for antiseptic filling by means of a hood (28) preferably open on one side and enclosing the row (5') sealing stations (5) and a sterilization chamber (20) is provided enclosing a feed path of the tops belt (12).

4. Apparatus according to claim 3 wherein a hygiene chamber (27) is provided for antiseptic filling by means of a hood (28) preferably open on one side and enclosing the row (5') sealing stations (5) and a sterilization chamber (20) is provided enclosing a feed path of the tops belt (12).

5. Apparatus according to claim 2 wherein the belt bridge (33) is an oblong hollow body with a box-type profile in a cross section to take up slack and guide the tops belt (12), and centering rings (37) are distributed over row (5') of the sealing stations (5) and attached to the belt bridge (33) a machine pitch (m) apart from each other and fit over the packs to center the openings.

6. Apparatus according to claim 5 wherein a hygiene chamber (27) is provided for antiseptic filling by means of a hood (28) preferably open on one side and enclosing the row (5') sealing stations (5) and a sterilization chamber (20) is provided enclosing a feed path of the tops belt (12).

7. Apparatus according to claim 2, wherein a stretching device (31) is arranged at an exit-side end (10) of the tops belt (12) from the row (5') from the sealing stations (5) and between drive rollers (9,11) for the belt (12).

8. Apparatus according to claim 7 wherein a hygiene chamber (27) is provided for antiseptic filling by means of a hood (28) preferably open on one side and enclosing the row (5') sealing stations (5) and a sterilization chamber (20) is provided enclosing a feed path of the tops belt (12).

9. Apparatus according to claim 5 wherein the front end (44) of the sealing head (36) is movable through the centering ring (37).

10. Apparatus according to claim 7 wherein a measurement and display apparatus is arranged between the exit-side end (10) of the row (5') of sealing stations (5) and the stretching device (31).

11. Apparatus according to claim 7 wherein the machine pitch (m) is three times the belt pitch (t) when the belt (12) is stretched.

12. Apparatus according to claim 11 wherein a measurement and display apparatus is arranged between the exit-side end (10) of the row (5') of sealing stations (5) and the stretching device (31).

13. Apparatus according to claim 12 wherein the belt bridge (33) is an oblong hollow body with a box-type profile in a cross section to take up slack and guide the tops belt (12), and centering rings (37) are distributed over row (5') of the sealing stations (5) and attached to the belt bridge (33) a machine pitch (m) apart from each other and fit over the packs to center the openings.

14. Apparatus according to claim 1, wherein a stretching device (31) is arranged at an exit-side end (10) of the tops belt (12) from the row (5') from the sealing stations (5) and between drive rollers (9,11) for the belt (12).

15. Apparatus according to claim 14 wherein a hygiene chamber (27) is provided for antiseptic filling by means of a hood (28) preferably open on one side and enclosing the row (5') sealing stations (5) and a sterilization chamber (20) is provided enclosing a feed path of the tops belt (12).

16. Apparatus according to claim 14 wherein the belt bridge (33) is an oblong hollow body with a box-type profile in a cross section to take up slack and guide the tops belt (12), and centering rings (37) are distributed over row (5') of the scaling stations (5) and attached to the belt bridge (33) a machine pitch (m) apart from each other and fit over the packs to center the openings.

17. Apparatus according to claim 14 wherein a measurement and display apparatus is arranged between the exit-side end (10) of the row (5') of sealing stations (5) and the stretching device (31).

18. Apparatus according to claim 14 wherein the machine pitch (m) is three times the belt pitch (t) when the belt (12) is stretched.

19. Apparatus according to claim 18 wherein a hygiene chamber (27) is provided for antiseptic filling by means of a hood (28) preferably open on one side and enclosing the row (5') sealing stations (5) and a sterilization chamber (20) is provided enclosing a feed path of the tops belt (12).

20. Apparatus according to claim 17 wherein a hygiene chamber (27) is provided for antiseptic filling by means of a hood (28) preferably open on one side and enclosing the row (5') sealing stations (5) and a sterilization chamber (20) is provided enclosing a feed path of the tops belt (12).

21. Apparatus according to claim 18 wherein the belt bridge (33) is an oblong hollow body with a box-type profile in a cross section to take up slack and guide the tops belt (12), and centering rings (37) are distributed over row (5') of the sealing stations (5) and attached to the belt bridge (33) a machine pitch (m) apart from each other and fit over the packs to center the openings.

22. Apparatus according claim 18 wherein a measurement and display apparatus is arranged between the exit-side end (10) of the row (5') of sealing stations (5) and the stretching device (31).

23. Apparatus according to claim 1 wherein a hygiene chamber (27) is provided for antiseptic filling by means of a hood (28) preferably open on one side and enclosing the row (5') sealing stations (5) and a sterilization chamber (20) is provided enclosing a feed path of the tops belt (12).

* * * * *